US008371205B1

(12) United States Patent
Proulx

(10) Patent No.: US 8,371,205 B1
(45) Date of Patent: Feb. 12, 2013

(54) RAILGUN WITH STEEL ENCLOSED GUN BORE

(76) Inventor: George Arthur Proulx, Castro Valley, CA (US)

( * ) Notice: Subject to any disclaimer, the term of this patent is extended or adjusted under 35 U.S.C. 154(b) by 0 days.

(21) Appl. No.: 12/958,193

(22) Filed: Dec. 1, 2010

Related U.S. Application Data

(63) Continuation-in-part of application No. 12/537,482, filed on Aug. 7, 2009, now Pat. No. 8,109,190.

(60) Provisional application No. 61/283,868, filed on Dec. 10, 2009, provisional application No. 61/339,328, filed on Mar. 2, 2010, provisional application No. 61/342,163, filed on Apr. 8, 2010, provisional application No. 61/404,214, filed on Sep. 28, 2010.

(51) Int. Cl.
*F41F 1/00* (2006.01)

(52) U.S. Cl. ..... 89/8; 124/3

(58) Field of Classification Search ..... 89/8; 124/3
See application file for complete search history.

(56) References Cited

U.S. PATENT DOCUMENTS

| | | | | |
|---|---|---|---|---|
| 1,370,200 | A | 3/1921 | Fauchon-Villeplee | |
| 1,421,435 | A | 7/1922 | Fauchon-Villeplee | |
| 4,361,761 | A * | 11/1982 | Treglio | 250/251 |
| 4,467,696 | A | 8/1984 | McNab et al. | |
| 4,485,720 | A | 12/1984 | Kemeny | |
| 4,846,911 | A | 7/1989 | Tackett et al. | |
| 4,858,511 | A | 8/1989 | Jasper, Jr. | |
| 5,076,135 | A * | 12/1991 | Hurn et al. | 89/8 |
| 5,183,956 | A * | 2/1993 | Rosenberg | 89/8 |
| 5,237,904 | A * | 8/1993 | Kuhlmann-Wilsdorf | 89/8 |
| 5,272,965 | A | 12/1993 | Loffler | |
| 5,332,422 | A | 7/1994 | Rao | |
| 5,454,289 | A | 10/1995 | Bacon et al. | |
| 6,725,759 | B1 | 4/2004 | Kathe et al. | |
| 7,409,900 | B1 | 8/2008 | Nechitailo et al. | |
| 7,614,393 | B1 | 11/2009 | Lu | |
| 8,109,190 | B2 * | 2/2012 | Proulx | 89/8 |
| 2006/0243124 | A1 | 11/2006 | Jackson | |
| 2010/0194212 | A1 | 8/2010 | Proulx | |
| 2012/0000450 | A1 * | 1/2012 | Solberg | 124/3 |
| 2012/0260901 | A1 * | 10/2012 | Proulx | 124/3 |

OTHER PUBLICATIONS

J. H. Beno et al, "Active Current Management for Four-Rail Railguns", pp. 39-44, IEEE Transactions on Magnetics, vol. 27, No. 1, Jan. 1991, U.S.A.

Jack S. Bemardes et al., "Analysis of a Capacitor-Based Pulsed-Power System for Driving Long-Range Electromagnetic Guns", pp. 486-490, IEEE Transactions on Magnetics, vol. 39, No. 1, Jan. 2003, U.S.A.

R. L. Ellis at al, "Influence of Bore and Rail Geometry on an Electromagnetic Naval Railgun System", pp. 43-48, IEEE Transactions on Magnetics, vol. 41, 2004, U.S.A.

H. D. Fair, "Advances in Electromagnetic Launch Science and Technology and Its Applications", IEEE Transactions on Magnetics, vol. 45, No. 1, Jan. 2009, pp. 225-230, U.S.A.

Peter Graneau at al., "Railgun Recoil Forces Cannot Be Modeled as Gas Pressure", pp. 4570-4571, IEEE Transactions on Magnetics, vol. 33, No. 5, Nov. 1997, U.S.A.

Jerry F. Kerrisk, "Electrical and Thermal Modeling of Railguns", pp. 399-402, IEEE Transactions on Magnetics, vol. Mag-20, No. 2, Mar. 1994, U.S.A.

(Continued)

*Primary Examiner* — Michael David
(74) *Attorney, Agent, or Firm* — Radio IP Law Group; Edward J. Radio

(57) ABSTRACT

An electromagnetic railgun (10) comprising at least two elongated high voltage rails (11), a sliding armature (50) making electrical contact with each high voltage rail (11), at least two elongated metal support beams (14) adapted to provide mechanical strength to the railgun (10), said support beams (14) being substantially parallel to the high voltage rails (11), and a plurality of metal support plates (30) aligned circumferentially around the support beams (14) and along the length of the railgun (10), said support plates (30) adapted to provide additional mechanical strength to the railgun (10); wherein the support plates (30) are electrically isolated from each other and from the support beams (14).

3 Claims, 9 Drawing Sheets

OTHER PUBLICATIONS

Dwight Landen et. al., "Eddy Current Effects in the Laminated Containment Structure of Railguns", pp. 150-156, IEEE Transactions on Magnetics, vol. 43, No. 1, Jan. 2007, U.S.A.
J. A. Leuer, "Electromagnetic Modeling of Complex Railgun Geometries", pp. 1584-1590, IEEE Transactions on Magnetics, vol. Mag-22, No. 6, Nov. 1986, U.S.A.
Chadee Persad, "A Review of U.S. Patents in Electromagnetic Launch Technology", pp. 493-497, IEEE Transactions on Magnetics, vol. 37. No. 1, Jan. 2001, U.S.A.
QuickField Version 5.7, Finite Analysis System, Tera Analysis, Ltd., Svendborg, Denmark, 2009, http://quickfield.com (last downloaded Nov. 1, 2010).
David Allan Adams, "Naval Guns Are Revolutionary", U.S. Naval Institute 2003, U.S.A.
Applied Pulsed Power, Inc., "Applied Pulsed Power Solid State Switch Products", pp. 1-3. Jun. 2008, Freeville, New York, U.S.A.
J.P. Barber et al., "A Survey of Armature Transition Mechanisms", pp. 47-51, IEEE Transactions on Magnetics, vol. 39, No. 1, Jan. 2003, U.S.A.
Rati Bishnoi, "Navy 'Rail Gun' Moves Forward", InsideDefense.com, Feb. 2, 2007, U.S.A.
Kershad P. Cooper et al., "Analysis of Railgun Barrel Material", pp. 120-125. IEEE Transactions on Magnetics, vol. 43, No. 1, Jan. 2007, U.S.A.
Richard S. Cowan et al., "Friction & Wear Under Very High Electromagnetic Stress", Georgia Institute of Technology, Atlanta, GA, USA, May 2004-Oct. 2004, U.S.A.
E.M. Drobyshevski et al., "Calculating the Liquid Film Effect on Solid Armature Rail-Gun Launching", pp. 53-58, IEEE Transactions on Magnetics, vol. 35. No. 1, Jan. 1999, U.S.A.
E.M. Drobyshevski et al., "Physics of Solid Armature Launch Transition into Arc Mode", pp. 62-66, IEEE Transactions on Magnetics, vol. 37, No. 1, Jan. 2001, U.S.A.
E.M. Drobyshevski et al., "The importance of three dimensions in the study of solid armature transition in railguns", pp. 2910-2917, Journal of Physics D: Applied Phys. 32 (1999), United Kingdom.
Thomas G. Engel et al, "Characterization of the Velocity Skin Effect in the Surface Layer of a Railgun Sliding Contact", pp. 1837-1844, IEEE Transactions on Magnetics, vol. 44, No. 7, Jul. 2006, U.S.A.
H.D. Fair, "Electromagnetic Launch: A Review of the U.S. National Program", pp. 11-16, IEEE Transactions on Magnetics, vol. 33, No. 1, Jan. 1997, U.S.A.
John E. Hatch, "Aluminum, Properties and Physical Metallurgy", p. 26, American Society for Metals, 1984, U.S.A.
Peter Y. Hsieh et al., "Mechnism of Porosity Formation in Transfer Films in Electromagnetic Launchers", pp. 319-321. IEEE Transactions on Magnetics, vol. 45, No. 1, Jan. 2009, U.S.A.
N.C. Jaitly et al., "Long Life Rotating Arc Gap Coaxial Switch for Mega-Amp, Kilo-Coulomb, High Action Switching of Multi-MJ Capacitor Banks", IEEE, pp. 643-646, 2005, U.S.A.
A.J. Johnson et al., "Elastic Waves in Electromagnetic Launchers", pp. 141-144, IEEE Transactions on Magnetics, vol. 43, No. 1, Jan. 2007, U.S.A.
R.E. Kothmann et al., "A Thermal Hydraulic Model of Melt-Lubrication in Railgun Armatures". pp. 86-91, IEEE Transactions on Magnetics, vol. 37, No. 1, Jan. 2001, U.S.A.
Chadee Persad. "Railgun Tribology—Chemical Reactions Between Contacts", pp. 391-396, IEEE Transactions on Magnetics, vol. 43, No. 1, Jan. 2007, U.S.A.
Chadee Persad et al., "Railgun Tribology: Characterization and Control of Multishot Wear Debris", pp. 173-177, IEEE Transactions on Magnetics, vol. 43, No. 1, Jan. 2007, U.S.A.
Richard F. Salant et al., "Simulation of Liquid Lubricant Injection in Electromagnetic Launcher Armatures", pp. 364-369, IEEE Transactions on Magnetics, vol. 43, No. 1, Jan. 2007, U.S.A.
Jerome T. Tzeng, "Dynamic Response of Electromagnetic Railgun Due to Projectile Movement", IEEE Transactions on Magnetics, vol. 39, No. 1, Jan. 2003, U.S.A.
W.A. Walls et al., "Applications of Electromagnetic Guns to Future Naval Platforms", pp. 262-267, IEEE Transactions on Magnetics, vol. 35, No. 1, Jan. 1999, U.S.A.
L.C. Woods, "The Current Melt-Wave Model", pp. 152-156, IEEE Transactions on Magnetics, vol. 33, No. 1. Jan. 1997. U.S.A.
Donald A. Lelonis et al.; "Boron Nitride Powder; A High-Performance Alternative for Solid Lubrication", Momentive Performance Materials Inc., 2006-2007, U.S.A.
Levy, United States Statutory Invention Registration No. H237, Published Mar. 3, 1987, "Armature for Small Caliber Electromagnetic Launch Projectile".
John Mallick, "Phenomenological Electromagnetic Modeling of Laminated-Containment Launchers", pp. 359-363, IEEE Transactions on Magnetics, vol. 43, No. 1, Jan. 2007, U.S.A.
Jerald V. Parker et al., "Loss of Propulsive Force in Railguns with Laminated Comtainment", pp. 442-446, IEEE Transactions on Magnetics, vol. 35, No. 1, Jan. 1999, U.S.A.

* cited by examiner

RAILGUN WITH STEEL ENCLOSED GUN BORE

RELATED PATENT APPLICATIONS

This patent application is a continuation-in-part of commonly-owned U.S. patent application Ser. No. 12/537,482 filed Aug. 7, 2009, entitled "Railgun System"; and additionally claims the benefit of the following four commonly-owned U.S. provisional patent applications: U.S. patent application 61/283,868 filed Dec. 10, 2009, entitled "Railgun with External Rails to the Gun Bore", U.S. patent application 61/339,328 filed Mar. 2, 2010, entitled "Railgun with Inductive and Direct Drive Options", U.S. patent application 61/342,163, filed Apr. 8, 2010, entitled "Railgun with Rails External to the Gun Bore—Part B", and U.S. patent application 61/404,214 filed Sep. 28, 2010, entitled "Railgun with Steel Encased Bore", all five of which patent applications are hereby incorporated by reference in their entireties into the present patent application.

TECHNICAL FIELD

This patent application pertains generally to the field of electromagnetic launchers, and specifically to railguns.

BACKGROUND ART

The background art will be discussed in conjunction with the following numbered references:

Reference 1. Kerrisk, J. F., "Electrical and Thermal Modeling of Railguns", *IEEE Transactions on Magnetics*, Vol. MAG-20, No. 2, March 1984, pp. 399-402.

Reference 2. Leuer, J. A., "Electromagnetic Modeling of Complex Railgun Geometries", *IEEE Transactions on Magnetics*, Vol. MAG-22, No. 6, November 1986, pp. 1584-1590.

Reference 3. Bacon, J. L., Laughlin, R. L., and Price, J. H., U.S. Pat. No. 5,454,289, Oct. 3, 1995, "Lightweight High L' Electromagnetic Launcher".

Reference 4. Bernardes, J. S., Stumborg, M. F., and Jean, T. E., "Analysis of a Capacitor-Based Pulsed-Power System for Driving Long-Range Electromagnetic Guns", *IEEE Transactions on Magnetics*, Vol. 39, No. 1, January 2003, pp. 486-490.

Reference 5. Ellis, R. L., Poynor, J. C., McGlasson, B. T., and Smith, A. N., "Influence of Bore and Rail Geometry on an Electromagnetic Naval Railgun System", *IEEE Transactions on Magnetics*, Vol. 41, 2004, pp. 43-48.

Reference 6. QuickField Version 5.7, Finite Analysis System, Tera Analysis, Ltd., Svendborg, Denmark, 2009, http://quickfield.com (last downloaded Nov. 1, 2010). QuickField is a finite element analysis system designed for a personal computer and is used to solve steady state and transient electromagnetic field problems defined in two dimensions.

Reference 7. Landen, D. and Satapathy, S., "Eddy Current Effects in the Laminated Containment Structure of Railguns," *IEEE Transactions on Magnetics*, Vol. 43, No. 1, January 2007.

Electromagnetic launchers, such as railguns, have received considerable interest due to their ability to accelerate projectiles without the use of explosives. A railgun uses the magnetic field between a pair of current-carrying high voltage rails to accelerate a current-carrying armature. Railguns are a promising non-explosive projectile launcher and have many potential applications, including weaponry and blasting holes in the earth during mining operations. For widespread use, a railgun must be economical, powerful, and durable.

One problem that has remained unsolved for many years has been the inability to properly confine the high voltage rails within the gun bore at power levels of interest and for useful lifetimes. During armature launch, the current in each of the rails results in a mutually repulsive force. The currents, one flowing from the gun base, or breech, and the other returning to the breech, repel each other due to standard principles of magnetism. Theoretical work published in the mid-1980s (References 1 and 2) argued that an electrically conducting containment vessel, such as a cylindrical barrel, should not be used to confine the high voltage rails. The papers showed that such a conducting cylinder could work only if the cylinder diameter was large compared to the separation distance between the rails. However, in that case, the intervening volume would need to be filled with dielectric material, and the resulting gun would be too heavy for practical use. If the conducting cylinder diameter was approximately equal to the distance between the high voltage rails, these papers indicated that the ability to convert rail current efficiently into magnetic propulsion of the armature would become vanishingly small. As a result of this, the conversion efficiency of electrical energy to kinetic energy of the projectile would be very poor. Numerous additional computer simulations have since shown this to be the case for the conditions outlined in the published papers.

As a result, many low power railguns are constructed using dielectric materials to mechanically constrain the rails. Many of these railguns have been used for test purposes with modest currents where rail containment with dielectric materials alone is feasible. For very powerful railguns operating at mega-ampere levels, however, some amount of rail containment using metals is required, as the tensile strength of dielectric materials is too low to adequately constrain the rails by themselves. Typically, the metal used for these guns is high strength steel. The use of some amount of metal in the confinement structure is possible, as has been shown by extensive work by the University of Texas (Reference 3) that if there is no electrical conduction of the confinement vessel along the gun bore axis, metal constraints can be used. These metal constraints conduct current in the circumferential direction only. In this case, a series of metal rings are placed around the rails from one end of the rail gun to the other. Each of the rings is electrically insulated from the other with use of electrical insulators between each pair of metal rings. Use of a large number of such steel rings can result in an effective means to prevent the rails from expanding in the lateral direction during the armature launch. This is described in Reference 3.

However, and because the remainder of the railgun containment is constructed of dielectrics, there remains a serious problem of gun barrel droop. The current-carrying high voltage rails must be made of a highly conductive material such as copper, or more commonly a copper alloy, and cannot contribute to railgun stiffness along the bore axis, because copper is a relatively soft and ductile metal. Dielectric materials generally have insufficient tensile strength to produce railgun stiffness for a long gun bore. Therefore, the gun barrel must be made relatively short. As a consequence of this and to achieve a desired exit velocity for the projectile, the acceleration rate is correspondingly increased, which severely burdens other railgun systems, such as the electrical power source and the rails, given the commensurately higher rail currents that are now required. In addition, in pulsed mode of railgun powering, there remains considerable uncertainty that the remaining dielectric materials will have the reliability and lifetime to provide a practical solution, especially given that these materials are used in tension.

The parent U.S utility patent application, entitled "Railgun System", focuses on lowering the sliding contact resistance between the armature and the rail of an electromagnetic railgun, using thermal energy to break apart the surface aluminum oxide layer residing on the rail surface. The armature nominally makes light mechanical surface contact with the rail surface so as to minimize rail surface damage due to gouging. The back armature surface is made flat for this purpose.

In said parent patent application, a second set of mechanical guide rails is used for guiding the armature and projectile. However, these guide rails are embedded into the surrounding dielectric material. Dielectric material is relatively weak mechanically and is limited in its ability to support these mechanical guide rails for a large number of launches without degradation of the underlying dielectric material.

The present invention remedies these and other problems associated with the prior art.

DISCLOSURE OF INVENTION

An electromagnetic railgun (10) comprising at least two elongated high voltage rails (11), a sliding armature (50) making electrical contact with each high voltage rail (11), at least two elongated metal support beams (14) adapted to provide mechanical strength to the railgun (10), said support beams (14) being substantially parallel to the high voltage rails (11), and a plurality of electrically conductive support plates (30) aligned circumferentially around the support beams (14) and along the length of the railgun (10), said support plates (30) adapted to provide additional mechanical strength to the railgun (10); wherein the support plates (30) are electrically isolated from each other and from the support beams (14).

BRIEF DESCRIPTION OF THE DRAWINGS

These and other more detailed and specific objects and features of the present invention are more fully disclosed in the following specification, reference being had to the accompanying drawings, in which.

DETAILED DESCRIPTION OF THE PREFERRED EMBODIMENTS

Figure 1:
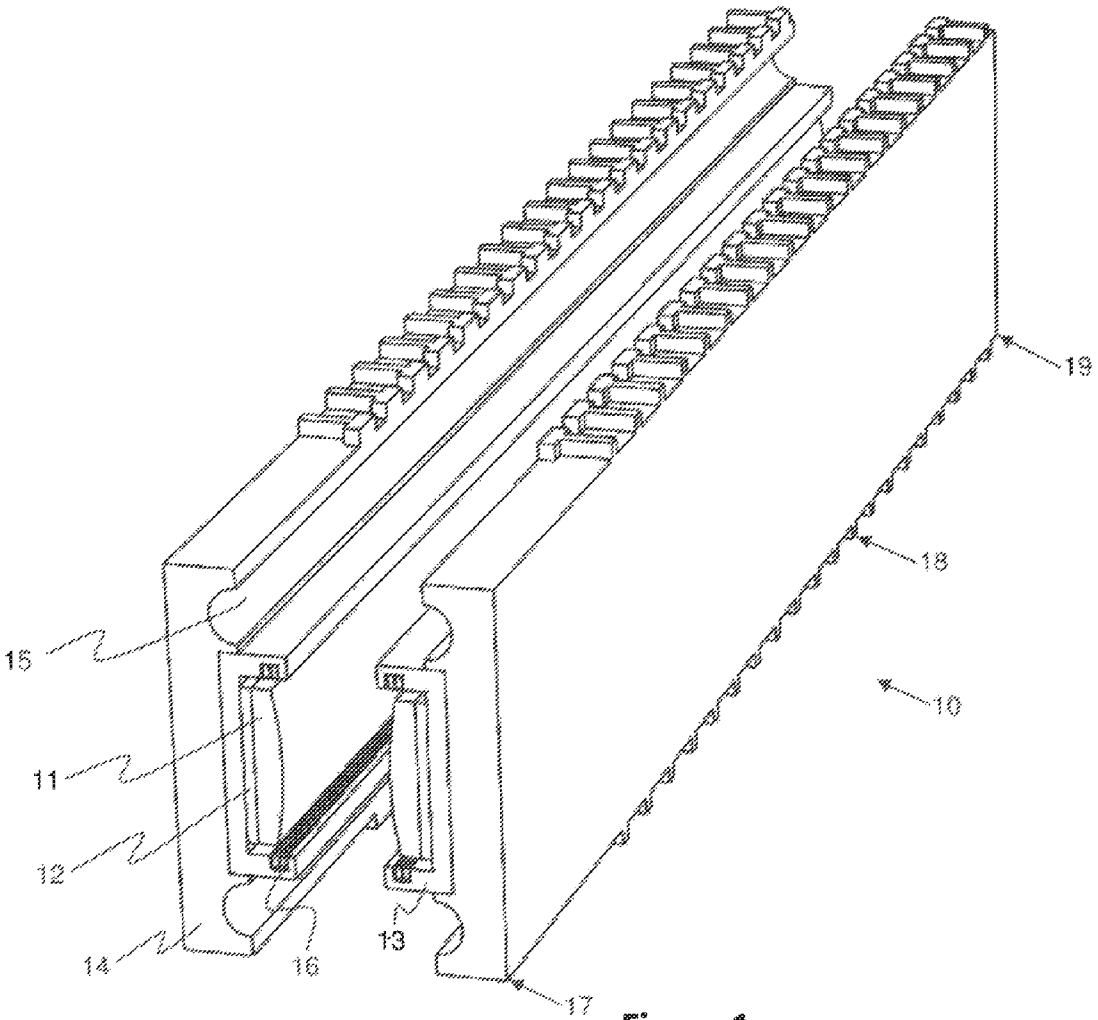
FIG. 1 is a perspective view of an electromagnetic railgun 10 of the present invention.

The railgun 10 comprises a breech 17, a muzzle 19, and a bore 18. An armature 50 propels a projectile (not illustrated) along the gun bore 18 between high voltage rails 11. There is a support beam 14 associated with each high voltage rail 11. A two-rail 11 system is illustrated herein, but this invention is not limited to two-rail 11 systems; any discrete number of rails 11 greater than or equal to two can be used. Each support beam 14 is proximate the back (outside) of each high voltage rail 11, as shown in FIG. 1.

Figure 2:
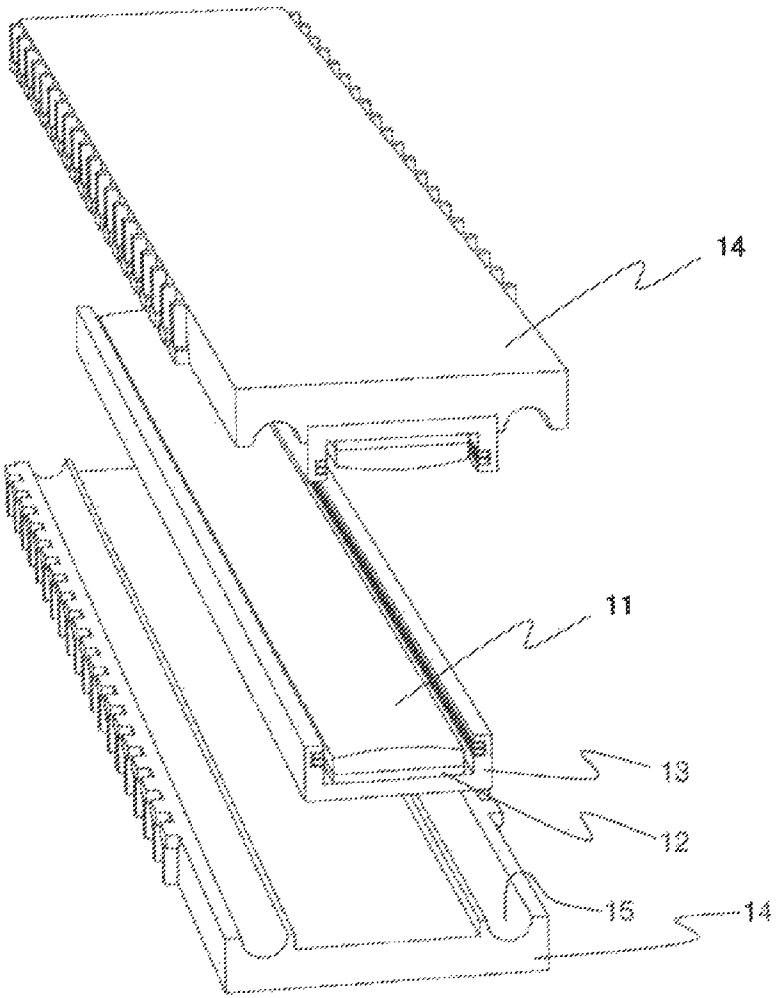
FIG. 2 is a perspective view of the railgun 10 of FIG. 1 showing a removable set of components comprising a high voltage rail 11, an electrical insulator 12, and a backing plate 13.

Each high voltage rail 11 is electrically isolated from its respective support beam 14 by being mounted onto an electrical insulator 12. Preferably, the electrical insulator 12 is made of a ceramic material. Insulator 12 can generally be any electrical insulator operable up to approximately 30 kV that is also mechanically robust, such as G10. Each electrical insulator 12 can be directly attached to a corresponding support beam 14. Preferably, however, each high voltage rail 11 and its associated electrical insulator 12 are together attached to a high strength (typically steel) backing plate 13. In this preferred embodiment, the backing plate 13 is then attached to the support beam 14, thus advantageously making it possible for the assembly 11, 12, 13 to be removable from the support beam 14 for maintenance or replacement of the high voltage rail 11. This embodiment is shown in FIG. 2. In either embodiment, the electrical insulator 12 is under compression during all states of operation of the railgun 10.

Each support beam 14 is made from metal, preferably high strength steel. Tensile strength in the approximate range of 800 MPa is desirable. While tensile strengths as high as 1600 MPa are possible, steels with such high tensile strength are typically used for cutting tools, and are not useful for this application. High strength steels with yield strength of approximately 800 MPa retain sufficient flexibility for this application.

Figure 3A:
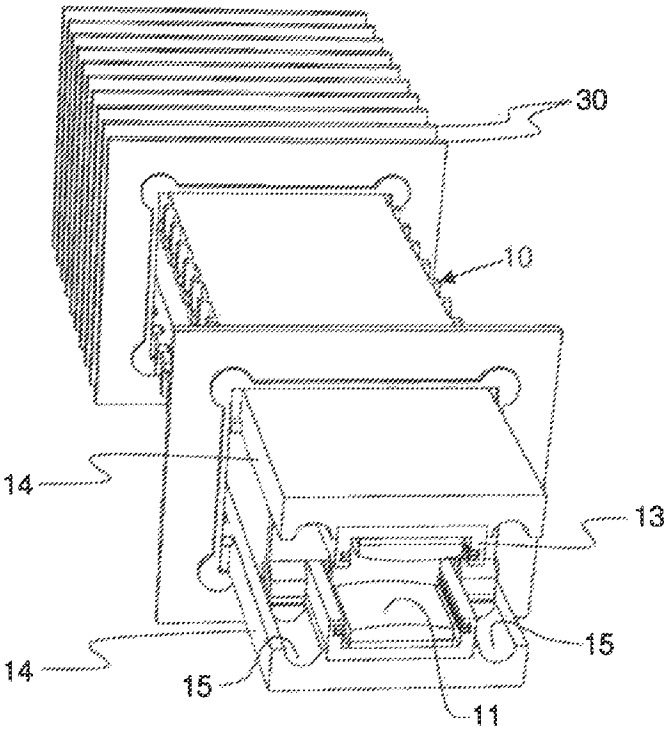
FIG. 3*a* is an embodiment of the present invention showing circumferential confinement plates 30.

For smaller and lighter weight railguns 10, titanium is the preferred metal for the support beams 14, backing plate 13, and confinement plates 30 (see FIG. 3*a*). The yield strength of titanium is approximately 50% that of steel.

The support beams 14 are placed proximate the rails 11 and extend along the full length of the railgun bore 18 from the breech 17 to the muzzle 19.

The support beams 14 are physically attached to the gun base 20 (see FIG. 9), which can be a turret or other mounting structure, but are not electrically grounded to the base 20. The support beams 14 are not electrically connected to each other. Similarly, the backing plates 13 are not electrically connected to the base 20, nor are they electrically connected to each other. The electrical insulation of the support beams 14 with respect to the rails 11; the electrical insulation of the support beams 14 with respect to the confinement plates 30; the electrical isolation of the support beams 14 with respect to each other and to the base 20; and the electrical insulation of the confinement plates 30 with respect to each other and to other parts of the railgun 10 allow for the railgun 10 to be fully enclosed in a confinement system made of metal (preferably steel), and to remain fully functional, with high electric to kinetic energy and power conversion efficiency.

Though in electrical isolation with respect to the high voltage rails 11, the support beams 14 make a secure mechanical confinement to the rails 11 all along the length of the gun bore 18. A primary purpose of the support beams 14 is to maintain planarity and parallelism between the rails 11 over the full length of bore 18. In this way, the bore 18 length can be extended compared with what is possible with the prior art.

The Figures illustrate a preferred open architecture in which the support beams 14 do not form a continuous electrical path circumferentially at any point along the bore 18. To maintain a high electric to kinetic energy and power conversion efficiency, it is preferred that the open architecture defined by the support beams 14 generally approximates that of the high voltage rails 11, as is shown in FIG. 1. In other words, the openings between the support beams 14 are proximate the openings between the rails 11.

On occasion and with enclosed gun bores of the prior art, a plasma arc will strike just behind the moving armature. It is generally assumed that the fast acceleration of the tight fitting armature around the gun bore and the creation of a partial vacuum in part create conditions for plasma arc formation. Because this is a lower impedance path than that of the armature, the arc superheats the surrounding gas and produces a pressure burst that can fracture the dielectric containment vessel walls of such existing railgun designs. In this embodiment of the present invention, on the other hand, the gun bore 18 is open to the atmosphere, thus preventing the formation of a partial vacuum behind the armature 50. Should a plasma arc form, any over-pressure is immediately vented to the atmosphere through the large openings in bore 18 all along its length.

Figure 3B:
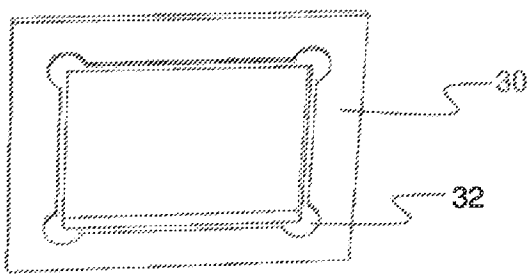
FIG. 3*b* illustrates a single confinement plate 30.

While being substantial in size and strength, the support beams 14 may be insufficient by themselves to keep the high voltage rails 11 from being forced apart during normal operation of the railgun 10. In many applications, the force of repulsion between the two high voltage rails (e.g., when the current flow is in the mega-ampere range) deflects the support beams 14 away from each other to the point of permanent damage unless there are additional mechanical restraints. Shown in FIG. 3*a* are several circumferential confinement plates 30 encircling the assembly comprising the support beams 14, rails 11, and insulators 12. A number of the confinement plates 30 have been removed from railgun 10 in FIG. 3*a* to more clearly show detail. One plate 30 is called out for detail in FIG. 3*b*. The confinement plates 30 keep the support beams 14, and therefore the high voltage rails 11, in place during an armature 50 and projectile launch.

Figure 4:
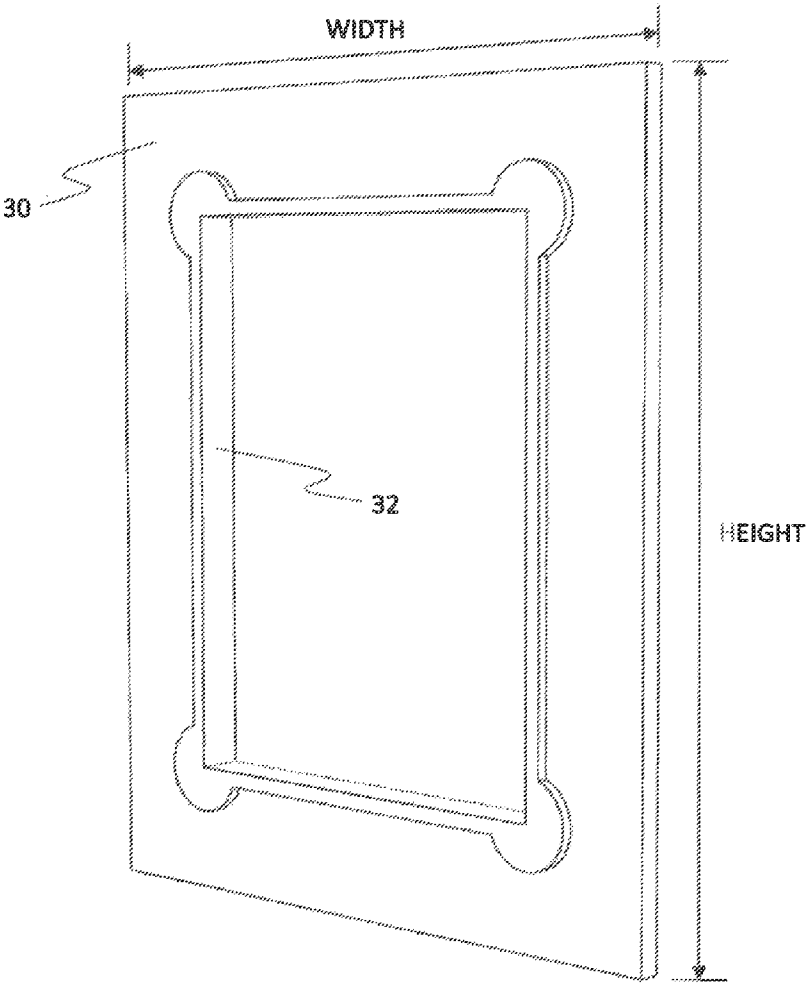
FIG. 4 illustrates further detail of a confinement plate 30.

Each confinement plate 30 consists of a continuous plate of metal (preferably steel) cut out in the center, with an insulator 32 fitted continuously along the inner surface of the cutout. This is shown in the detail of FIGS. 3*a* and 4. The confinement plates 30 are electrically insulated from all other electrically conductive parts 11, 14, 15 in the railgun 10. Insulator 32 is preferably ceramic, is under compression, and makes physical contact with other parts 14 of the rail assembly 10. While the Figures show the confinement plates 30 as having a non-square rectangular shape, other geometries, such as square, circular or elliptical, can be used.

The plate 30 thickness should be a small fraction of the plate 30 height and width. Also, the confinement plates 30 should be spaced apart sufficiently that the plate 30 thickness is a small fraction of the distance between adjacent plates 30. Both requirements are to insure that the confinement plates 30 interfere only slightly with the magnetic field lines generated by the flow of current down one rail 11 and back along the other rail 11. This is to insure that the inductance, and more precisely the inductance per unit length of the current flow in the high voltage rails 11, not be significantly reduced. As the volume defined by the space between any two confinement plates 30 becomes a smaller fraction of the volume occupied by any one of the confinement plates 30, the high voltage rail 11 inductance per unit length (L') becomes smaller. The metric L' is a key parameter for defining the conversion efficiency of electrical energy from the power generator to kinetic energy in the armature 50 and its associated projectile; Reference 4.

At the same time, the confinement plates 30 must do their part to hold the support beams 14 and high voltage rails 11 in place during the armature 50 and projectile launch. Therefore, the cross-section of the support plates 30 cannot be arbitrarily small. For example, consider the railgun under development by the United States Navy; Reference 5. This represents a particularly powerful railgun and is thus an extreme example. In this case, the requirement is to launch a projectile using approximately 6 mega-amps of current. Using a commercially available computer code (Reference 6) for calculating the magnetic fields for a given rail 11 geometry, and using a set of high voltage rails 11 that are 30 cm high and 30 cm apart, the confinement plates 30 must be able to counter an expansion force of $1.9\times10^7$ Newtons/meter, which is the amount of force exerted on the rail 11 per meter of length along the axis of the gun bore 18. This is equivalent to $1.1\times10^2$ kilo-pounds/in$^2$ per inch along the length of the gun bore 18. Assuming an inter-support plate 30 spacing of 12 inches, each steel support plate 30 must support $1.1\times10^2$ kpsi$\times12=1.32\times10^3$ kpsi. For high strength steel with a yield strength of 800 MPa, or approximately 120 kilo-pounds/in$^2$ (kpsi), applying a factor of 2× for safety (i.e., using 400 MPa or 60 kpsi) results in a required cross-sectional area of $2.2\times10^1$ in$^2$ or $1.42\times10^2$ cm$^2$. The confinement plate 30 has an upper and lower side to confine the expansion force, so that the plate 30 cross-section need be only of this result, or 70 cm$^2$. A plate 30 width of 2 cm and height of 10 cm more than suffices to meet this confinement requirement. A 2 cm thick plate 30 with an inter-plate spacing of 30 cm represents a filling factor of approximately 7%. Therefore, the reduction in the inductance should be no worse than this amount. In fact, it is considerably less than this, as the magnetic flux is determined primarily by the volume between the two high voltage rails 11, and the flux is for the most part diverted around these confinement plates 30.

While Reference 3 shows confinement rings, what has not been appreciated prior to this invention is the great advantage of using a longitudinal support beam 14 in conjunction with circumferential confinement plates 30, under the appropriate operating conditions. It has been widely believed in the field for approximately 25 years that the use of metal conductors that confine the high voltage rails 11 in both the longitudinal and circumferential directions simultaneously would result in poor electrical efficiency. Leading lines of research continue with development of confinement rings only (Reference 7), which continues to teach away from the present invention. Therefore, practitioners in the art have used metal confinement devices in the circumferential direction only to address the serious problem of high voltage rail repulsion. The issue of gun bore droop has been tentatively resolved by designing railguns with short bore lengths and accommodating for this with sometimes exceedingly demanding requirements in other parts of the railgun system.

The reason that practitioners believed that support beams 14 and confinement plates 30 could not be used together was the result of the previously-cited theoretical papers published in the scientific literature in the mid-1980s; References 1 and 2. These papers taught, and rightly so, that a single electrically conducting confinement tube brought into close proximity to the high voltage rails of a railgun would result in a railgun of poor electrical efficiency. What was shown in these papers and with detailed mathematics was that it was the combination of the confinement tube's electrical conductivity in the circumferential direction together with its simultaneous conductivity in the longitudinal direction that leads to the poor efficiency.

What was not recognized until this invention, however, was that: (1) by separating the electrical conductivity in the circumferential direction from that in the longitudinal direction using a mechanical confinement structure 30, 14 made of metal, (2) by insuring that each element 30, 14 of the confinement structure be electrically isolated from each other element 30, 14, and (3) by introducing into the confinement structure large open gaps between adjacent confinement plates 30 in conjunction with a wide gap in both the top and bottom regions between the support beams 14 to allow for unimpeded passage of the magnetic flux generated from the high voltage rail 11 current to pass, a full metal enclosure of the railgun 10 can be accomplished in a highly efficient and elegant manner.

Guide Rails 15

Practitioners in the art have reported substantial problems with vibration of the armature during acceleration. This is understandable, as acceleration to supersonic velocities for this application is often required. Today, all railguns are designed so that high voltage rails are used to conduct current across the armature while simultaneously acting as mechanical guide rails for the armature and projectile. The present invention recognizes that it is easier to suppress vibrations when the weight and guidance of the armature 50 and projectile are carried on separate rails 15 from those 11 of the electric power flow to and from the armature 50.

Figure 5:
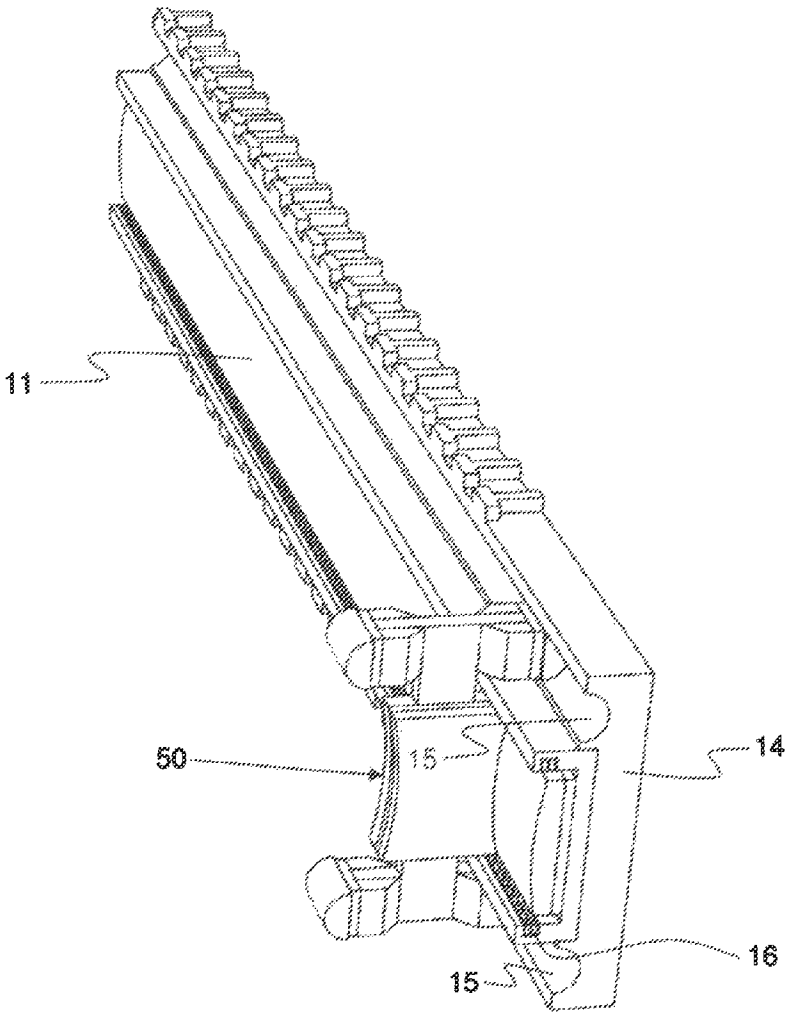
FIG. 5 is a perspective view of an embodiment of the present invention showing armature 50 positioned in a pair of guide rails 15.

In this invention, the support beams 14 are placed just behind their associated high voltage rails 11, and by judicious design serve the dual function of mechanical support for the high voltage rails 11 and mechanical guides for the armature 50 and projectile. This is shown in FIG. 5. The guide rails 15 are used to support the weight of the armature 50 and the projectile, and to guide the armature 50 and the projectile down the gun bore 18 during launch. Each high voltage rail 11 is used to supply current to and from the conducting plate 73 portion of the armature 50.

The weight bearing rails 15, which are typically made of steel, are designed for weight loading and wear resistance. In this invention, these two functions are separated and optimized by the different types of rails 11, 15. To further minimize the potential for vibration, each mechanical rail 15 can be integrated directly into the support beam 14, as shown in FIG. 5. Alternatively, each mechanical rail 15 can be a separate entity attached to a support beam 14. Instead of making direct contact, one or more armature attachments 74 can ride on a fluid or gas layer between the attachment 74 and its respective guide rail 15.

Convex High Voltage Rails 11

Figure 6:
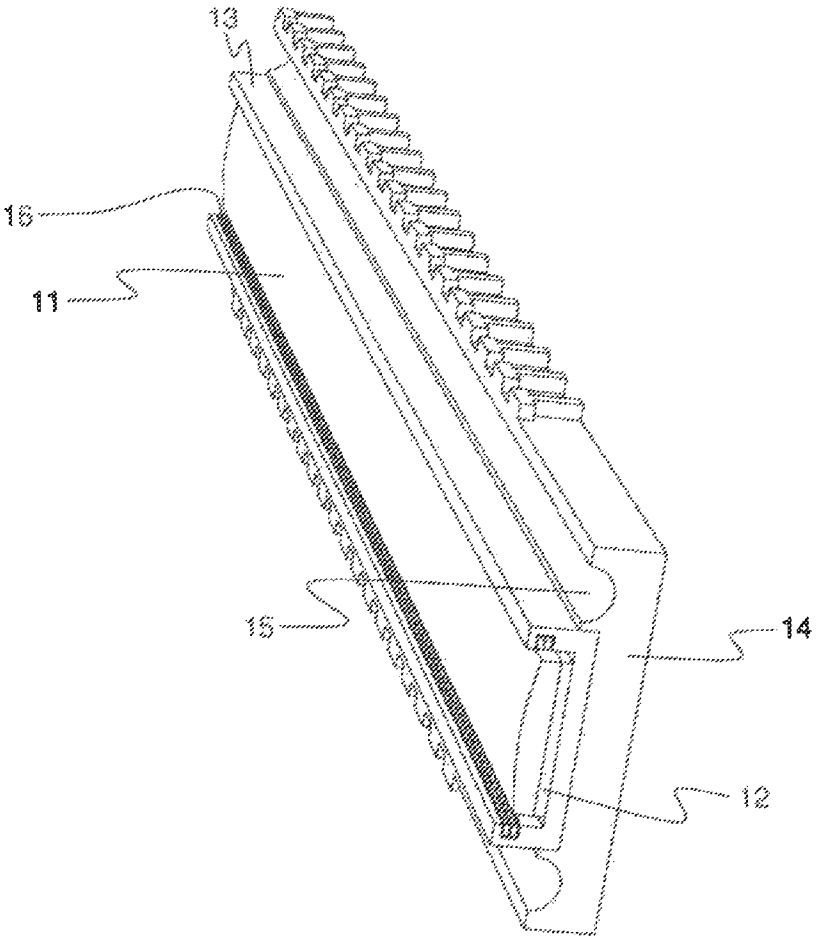
FIG. 6 is a perspective view of an embodiment of the present invention showing lubrication receptacles 16 and a convex curvature of a high voltage rail 11.

Shown in FIG. 6 is an example of a high voltage rail 11 with a convex curve on its front surface (i.e., the surface facing armature 50). Practitioners in the art today employ either flat or concave curvatures only. Flat high voltage rails have been used extensively for research purposes at low power where mechanical guidance has not been of primary concern. At high power and velocity, concave rail cross sections have been employed to aid in armature mechanical support and guidance in the gun bore. However, this runs counter to the magnetic field shaping that is natural to the railgun 10. Near the edges of the rails for the concave rail-type gun are flux line concentrations, which are the result of surface current concentrations at the high voltage rail edges. As a result of this excessive rail edge heating, deformation and early rail wearout occur.

The present invention preferably uses high voltage rails 11 having a convex front surface, i.e., the surface making contact with armature 50, so that the surface current density near the rail 11 edge can be managed more easily. By adjusting the radius of curvature, which can vary from center to edge while overall being convex, the surface current density can be managed quite well.

Lubrication Receptacles 16

Also shown in FIG. 6 are lubrication receptacles 16. Preferably, receptacles 16 are part of a removable backing plate 13, and therefore easily removable along with the high voltage rail 11. Receptacles 16 can be located on both sides of a rail 11, and capture a lubricant, such as liquid aluminum, that is produced at the sliding electrical contact 73, which is preferably made from aluminum alloy. Each receptacle 16 preferably extends from the breech 17 to the muzzle 19, and is part of the backing plate 13 itself. The receptacle 16 typically contains a material with enhanced surface area to volume ratio. Such an architecture can efficiently collect, trap, and hold the incident lubricant after it has solidified. Preferably, the material comprising receptacle 16 is a honeycomb of steel or stainless steel with a highly roughened surface which is replaceable within the receptacle 16. In operation of the railgun 10, hot liquid aluminum or another lubricant is jetted at generally right angles to the direction of armature 50 motion along the sliding contact 73 region. The lubrication receptacles 16 are designed in conjunction with the convex nature of the high voltage rails 11, so that the jetted lubrication is incident on the openings of the receptacle 16.

As is shown in FIG. 6, the receptacle 16 is designed with a large number of cells. Preferably, each cell has cell walls that come to a sharp edge at the forwardmost point of the cell, i.e., the part of the cell closest to the muzzle 19.

These receptacles 16 serve the same purpose as the liquid aluminum sump described in the parent patent applications.

In a preferred embodiment, the materials in receptacles 16 are designed with a large surface area to be able to hold a large amount of solidified aluminum before need of replacement. The knife edge design of the forwardmost edges is designed to prevent backsplash of the incident liquid aluminum. The materials in the receptacles 16 are made as separate parts to the backing plate 13 and fabricated into sections so as to accommodate thermal expansion and contraction effects.

Armature 50 Design

Figure 7:
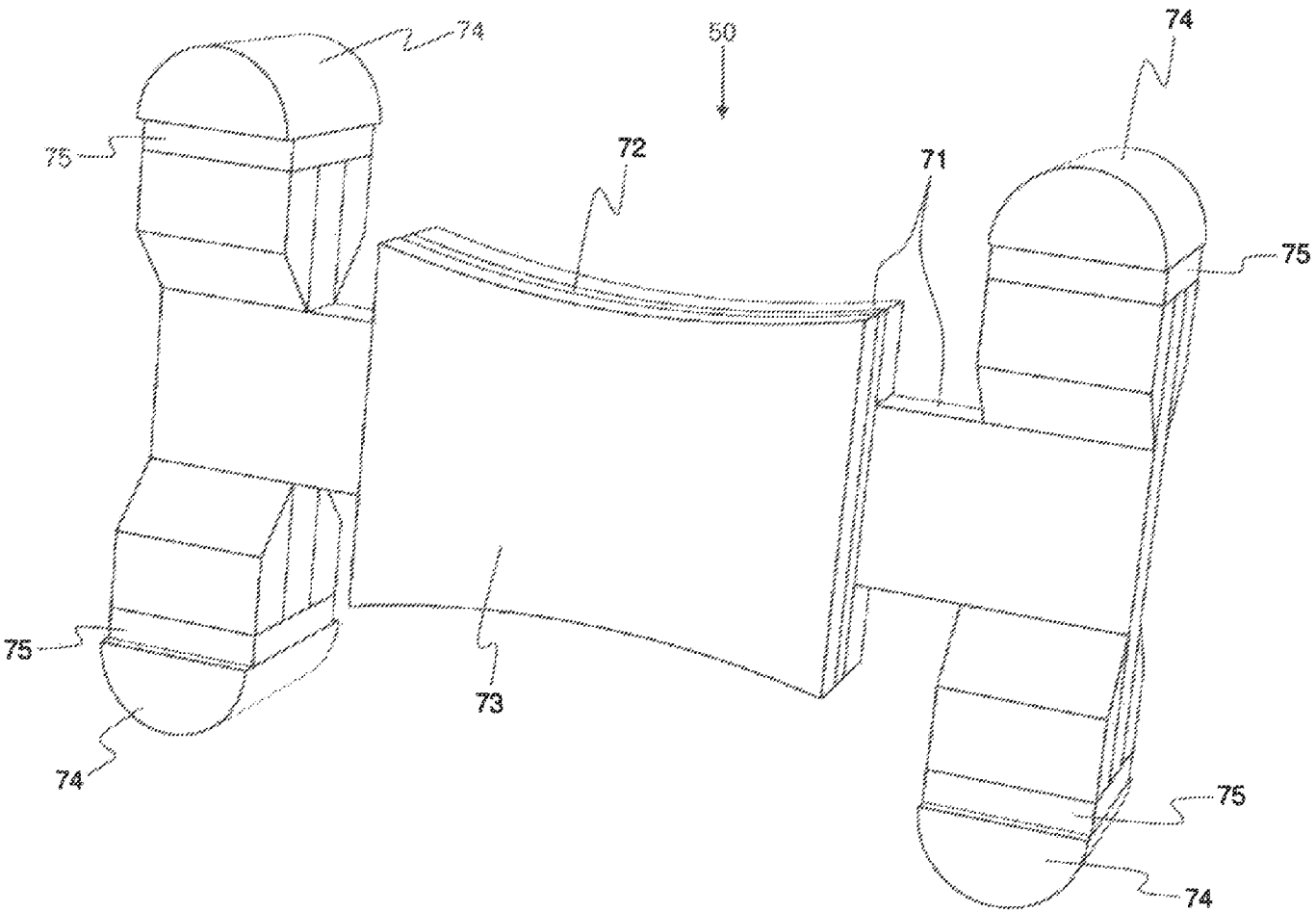
FIG. 7 is a perspective view of an armature 50 suitable for use in the present invention.

FIG. 7 shows a perspective view of the armature 50. There are three layers to the armature 50. The first, which is forwardmost (closest to the muzzle 19), is the armature base 71. This part is preferably made of steel. The armature base 71 is connected to a set of armature attachments 74. Just behind the armature base 71 and mechanically attached thereto is a continuous plate 72 of electrically insulating material. Preferably, this material is ceramic, and is under compression. The electrically insulating plate 72 insures that all of the current from one high voltage rail 11 is conducted solely to the second high voltage rail 11. The third layer (which faces the breech 17) is a low resistivity electrically conducting plate 73 that conducts current from one high voltage rail 11 to the other 11 as the armature 50 slides along the bore 18. This plate 73 is preferably made of aluminum or aluminum alloy, and is electrically insulated from all parts in the railgun 10 except for the high voltage rails 11.

Preferably, armature 50 has at least one attachment 74 on each side that fits into a guide rail 15. Each attachment 74 makes sliding contact with at least part of its respective guide rail 15 surface. The attachment 74 can ride on a fluid or gas layer between the attachment 74 and the guide rail 15. Attachments 74 are mechanically secured to the remainder of the armature 50, but electrically insulated from the armature base 71 by means of insulators 75.

Tapered Railgun 80

Figure 8:
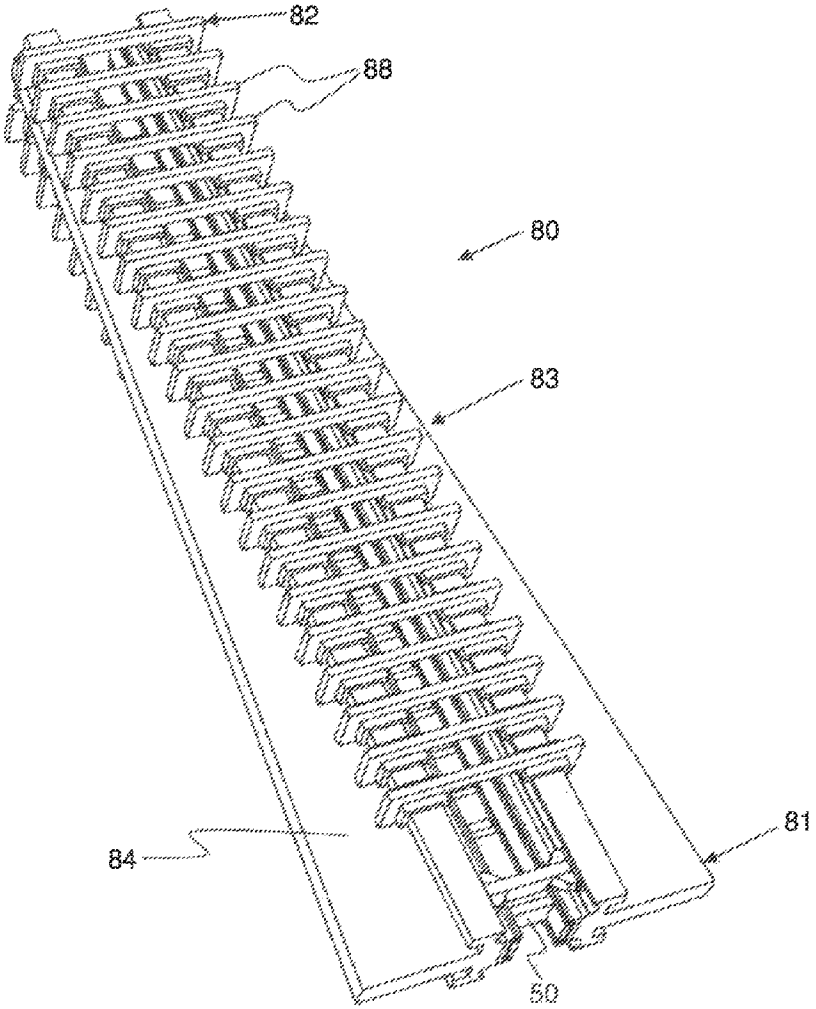
FIG. 8 is a perspective view of an embodiment of the present invention comprising a tapered support beam 84.

In the embodiment of this invention illustrated in FIG. 8, the support beams 84 are tapered from the breech 81 to the muzzle 82, with the widest portions of the tapered support beams 84 at the breech 81. In this embodiment, each of the confinement plates 30 is replaced with a pair of external clamps 88 that are independent of each other. Each clamp 88 is electrically insulated from the tapered support beams 84, from all other clamps 88, and from every other metal part in the railgun 80. At the inner edges of each clamp 88 is an electrical insulator (not illustrated) which makes physical contact with the tapered support beams 84. The preferred material for the electrical insulator is ceramic, and the electrical insulator is under compression.

When the support beams 84 are cantilevered at the gun base 81, the gun 80 length can be extended further, compared with a non-cantilevered design. This can be of further benefit in lengthening the gun barrel (bore) 83 and being able to either achieve a higher exit velocity for the projectile for a given set of input parameters, or, alternatively, to be able to reduce the input parameters to achieve a fixed output specification.

Due to the extension of metal from the support beam 84 further from the rail 11, the inductance per unit length (L') varies along the length of the gun 80. L' is lowest near the gun breech 81 and is highest near the muzzle 82. With all else, and especially the drive current, being held fixed, the armature 50 acceleration continues to increase along the gun barrel 83 with the tapered design.

Base 20

Figure 9:
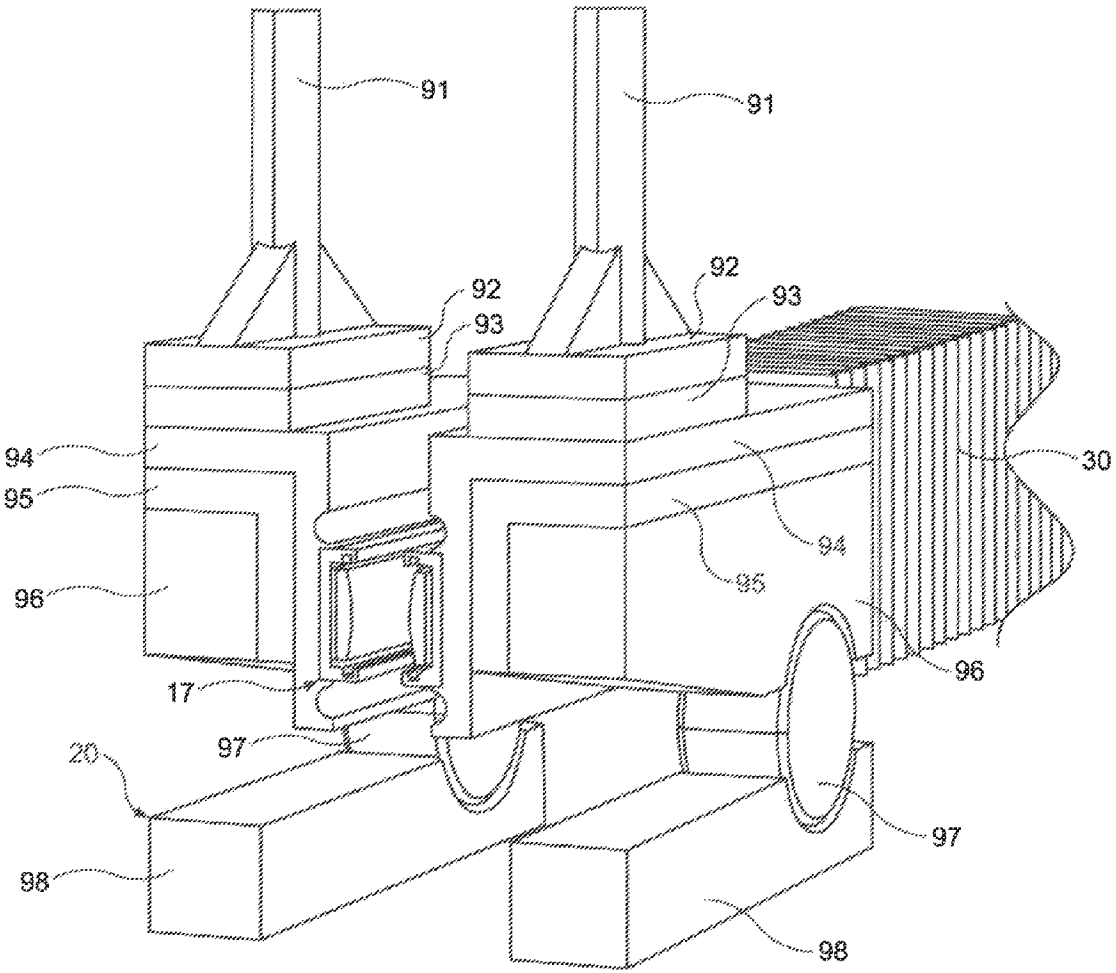
FIG. 9 is a perspective view of a railgun 10 of the present invention mounted onto a base 20.

FIG. 9 illustrates railgun 10 mounted on a support base 20, and shows that the support beams 14 (including their extensions 94) are insulated from all of the metal (usually steel) components 91, 92, 96, 97, 98 of base 20.

In this embodiment, support beams 14 are extended in a horizontal direction near the breech 17, forming extended support beams 94, which provide additional mechanical support. In this embodiment, base 20 is a pivoting turret, but other types of bases 20, such as fixed bases and shoulder mounted bases, can be employed. In this illustrated embodiment, a fixed portion 98 of the base is mounted to a surface of a ship, tank, or other large object. Wheels 97 allow railgun 10 to pivot with respect to the fixed portion 98. Top brackets 91 and top plates 92 are used to mechanically secure extended support beams 94 to the breech 17 end of turret 20 via insulators 93. Similarly, insulators 95 electrically isolate support beams 14, 94 from the railgun portion 96 of turret 20. Railgun portion 96 provides additional mechanical support.

Insulators 93, 95 are preferably fabricated of ceramic, and are under compression. Ceramic, including fracture toughened ceramic, has a compressive strength of around 2,100 to 2,400 Mpa, as noted in various engineering journals. As noted previously, the tensile strength of steel is typically quoted as around 800 Mpa. Therefore, there is a need for approximately 40% less ceramic area 95 under compression than the cross-sectional area of the support beams 14 under tension. A considerable engineering margin, by several factors, has thus been incorporated in the embodiment illustrated in FIG. 9.

Steel bolts (not illustrated) within each top bracket 91 can be run through the adjacent ceramic insulator 93 and directly into the adjacent steel extended support beam 94 In extended support beam 94, the bolt can be run through an insulated hole, which is typically lined with ceramic, and terminated with a set of steel and ceramic washers. In this way, there is no direct electrical path through the bolt from one set of steel parts 91, 92 to another 94. In this embodiment, the ceramic washers are under compression.

The above description is included to illustrate the operation of the preferred embodiments, and is not meant to limit the scope of the invention. The scope of the invention is to be limited only by the following claims. From the above discussion, many variations will be apparent to one skilled in the art that would yet be encompassed by the spirit and scope of the prevent invention.

What is claimed is:

1. An electromagnetic railgun having an elongated bore, and further comprising:

at least two elongated high voltage rails;

a sliding armature making electrical contact with each high voltage rail, and adapted to propel a projectile along the bore;

a metal backing plate associated with each high voltage rail and adapted to provide mechanical strength to counter magnetic forces of repulsion operating upon the high voltage rails;

an electrically insulative layer positioned between each high voltage rail and its associated backing plate; and an electrically conductive support beam associated with each combination of high voltage rail, electrically insulative layer, and backing plate, said support beam providing further mechanical strength to counter said repulsive forces; whereby each combination of high voltage rail, electrically insulative layer, and backing plate is removable with respect to its associated support beam.

2. The railgun of claim 1 wherein:

the support beams are electrically insulated front each other; and the backing plates are electrically insulated from each other.

3. An electromagnetic railgun comprising:

at least two elongated high voltage rails;

a sliding armature making electrical contact with each high voltage rail and adapted to propel a projectile along the length of the railgun; and at least two elongated support beams adapted to provide mechanical strength to the railgun, said support beams being substantially parallel to the high voltage rails; wherein:

each support beam is placed directly behind an associated high voltage rail, and the set of metal support beams has an open geometry in the circumferential direction such that there is no continuous electrically conductive path through the support beams in a circumferential direction.

* * * * *

UNITED STATES PATENT AND TRADEMARK OFFICE

CERTIFICATE OF CORRECTION

PATENT NO. : 8,371,205 B1
APPLICATION NO. : 12/958193
DATED : February 12, 2013
INVENTOR(S) : George Arthur Proulx It is certified that error appears in the above-identified patent and that said Letters Patent is hereby corrected as shown below:

Title page, Column 2, Item (74)

"Radio IP Law Group; Edward J. Radio" should be corrected to read --Radlo IP Law Group; Edward J. Radlo--.

Signed and Sealed this
Fourteenth Day of May, 2013

Teresa Stanek Rea
*Acting Director of the United States Patent and Trademark Office*